US010431043B2

(12) United States Patent
Lawson et al.

(10) Patent No.: US 10,431,043 B2
(45) Date of Patent: Oct. 1, 2019

(54) INTEGRATED GAME-SPECIFIC PROGRESSIVE CONTROLLER SHARED IN A GAMING SYSTEM

(71) Applicant: IGT, Las Vegas, NV (US)

(72) Inventors: William R. Lawson, Reno, NV (US); Ronald Papson, Reno, NV (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 15/854,945

(22) Filed: Dec. 27, 2017

(65) Prior Publication Data

US 2019/0197832 A1 Jun. 27, 2019

(51) Int. Cl.
*G07F 17/32* (2006.01)
*G07F 17/34* (2006.01)

(52) U.S. Cl.
CPC ..... *G07F 17/3258* (2013.01); *G07F 17/3225* (2013.01)

(58) Field of Classification Search
CPC ..... G07F 17/34
See application file for complete search history.

(56) References Cited

U.S. PATENT DOCUMENTS

2008/0090653 A1* 4/2008 Kuehling ..... G07F 17/32 463/29
2011/0275431 A1* 11/2011 Hirzel ..... A63F 13/46 463/23
2013/0157757 A1* 6/2013 Riggs ..... G07F 17/3258 463/27

* cited by examiner

*Primary Examiner* — Robert T Clarke, Jr.
(74) *Attorney, Agent, or Firm* — Sheridan Ross P.C.

(57) ABSTRACT

Technology for operating a gaming system is disclosed. In one embodiment, an integrated progressive controller is maintained within each one of a plurality of electronic gaming machines (EGMs) in the gaming system. Progressive award information then may be distributed, by each integrated progressive controller within each of the plurality of EGMs to each integrated progressive controller within each remaining EGM of the plurality of EGMs, such that the progressive award information is kept consistent between each integrated progressive controller within each of the plurality of EGMs in the gaming system.

17 Claims, 4 Drawing Sheets

INTEGRATED GAME-SPECIFIC PROGRESSIVE CONTROLLER SHARED IN A GAMING SYSTEM

BACKGROUND

The present disclosure relates in general to gaming devices and systems, and more particularly to distributing progressive award information in a gaming system.

Games of chance have been enjoyed by people for many years and have undergone increased and widespread popularity in recent times. As with most forms of entertainment, some players enjoy playing a single favorite game, while others prefer playing a wide variety of games. In response to the diverse range of player preferences, gaming establishments commonly offer many types of electronic games. Many electronic gaming machines (EGMs), such as slot machines and video poker machines, have been a cornerstone of the gaming industry for several years. The EGMs include specially programmed computers and contain multiple external interfaces. Further, the EGMs each provide various gaming functionality (i.e., differing games), which each have unique attributes to enhance player enjoyment.

BRIEF SUMMARY

Various embodiments for operating a gaming system are disclosed. In one embodiment, an integrated progressive controller may be maintained within each one of a plurality of electronic gaming machines (EGMs) in the gaming system. Progressive award information may then be distributed, by each integrated progressive controller within each of the plurality of EGMs to each integrated progressive controller within each remaining EGM of the plurality of EGMs, such that the progressive award information is kept consistent between each integrated progressive controller within each of the plurality of EGMs in the gaming system.

The foregoing summary has been provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

Aspects of the present disclosure are illustrated by way of example and are not limited by the accompanying drawings.

DETAILED DESCRIPTION OF THE DRAWINGS

Figure 1:
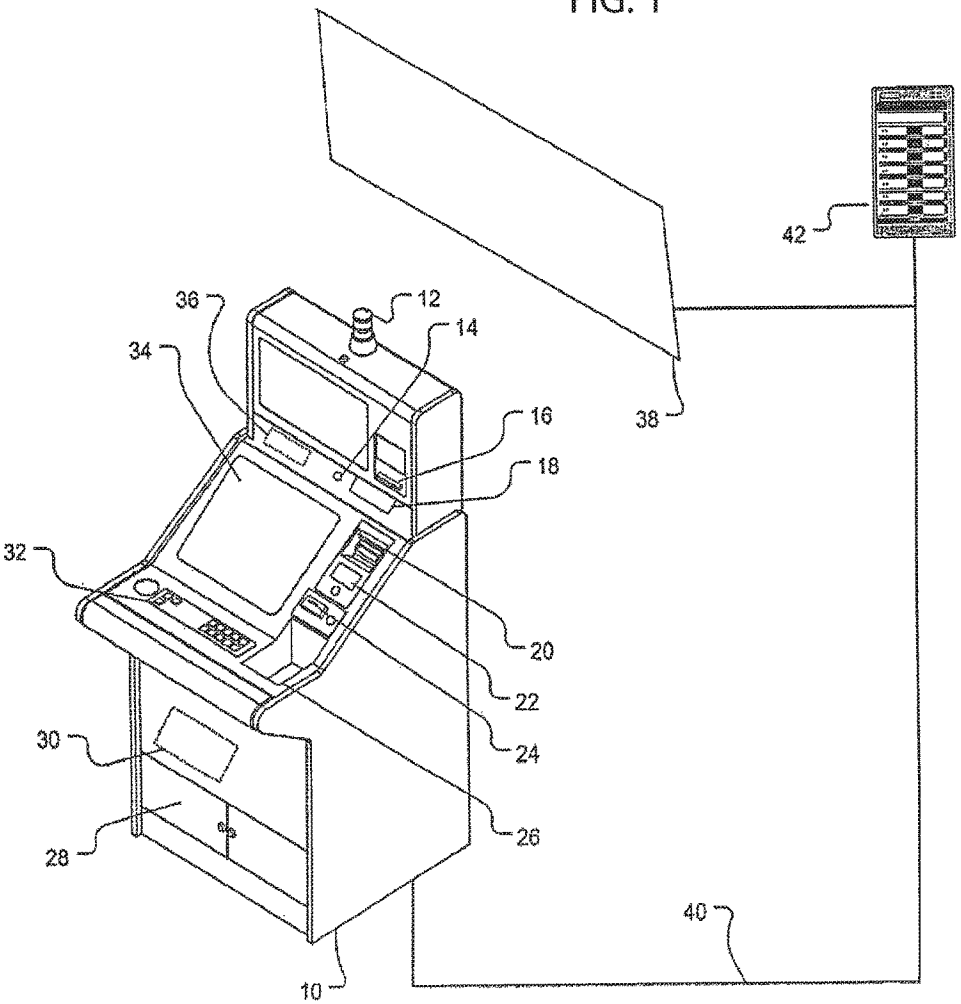
FIG. 1 is a perspective view of one embodiment of a slot machine or gaming device suitable for use in a gaming system.

In general, gaming machines, such as electronic gaming machines (EGMs), require a player to place or make a wager to activate a primary or base game. The award may be based on the player obtaining a winning symbol or symbol combination and on the amount of the wager (e.g., the higher the wager, the higher the award). Symbols or symbol combinations that are less likely to occur usually provide higher awards. In such gaming machines, the amount of the wager made on the base game by the player may vary. For instance, a gaming machine may allow the player to wager a minimum number of credits, such as one credit (e.g., one penny, nickel, dime, quarter or dollar) up to a maximum number of credits, such as five credits. The player may make this wager a single time or multiple times in a single play of a primary game. For instance, a slot game may have one or more pay lines and the slot game may allow the player to make a wager on each pay line in a single play of the primary game. Slot games with 1, 3, 5, 9, 15 and 25 lines may be provided. Thus, a gaming machine, such as one providing a slot game, may allow players to make wagers of substantially different amounts on each play of the primary or base game ranging, for example, from one credit up to 125 credits (e.g., five credits on each of 25 separate pay lines). This principle holds true for other wagering games, such as video draw poker, where players may wager one or more credits on each hand and where multiple hands may be played simultaneously. Of course, different players play at substantially different wagering amounts or levels and at substantially different rates of play.

Secondary or bonus games may also be provided in the gaming machines, where the secondary or bonus games may provide an additional award to the player. Secondary or bonus games may or may not require an additional wager by the player to be activated, and may be activated or triggered upon an occurrence of a designated triggering symbol or triggering symbol combination in the primary or base game. For instance, a bonus symbol occurring on the pay line on the third reel of a three-reel slot machine may trigger the secondary or bonus game. When a secondary or bonus game is triggered, the gaming machine may indicate this to the player through one or more visual and/or audio output devices, such as the reels, lights, display units, speakers, video screens, etc. thereof. Part of the enjoyment and excitement of playing certain gaming machines is the occurrence of these secondary or bonus games (even prior to the player being aware of what the bonus award will be). In other words, obtaining a bonus award is part of the enjoyment and excitement for players.

Progressive awards may also be provided in gaming machines. A progressive award may be an award amount that includes an initial amount funded by a casino and an additional amount funded through a portion of each wager made on the progressive gaming machine. For example, 1% to 5% of each wager placed on the primary game of the gaming machine associated with the progressive award may be allocated to the progressive award or progressive award fund. The progressive award grows in value as more players play the gaming machine, and thus, portions of these players' wagers are allocated to the progressive award. When a player obtains a winning symbol or symbol combination, which is associated with and therefore results in winning the progressive award, the accumulated progressive award is provided to the player. After the progressive award is provided to the player, the amount of the next progressive award may be reset to an initial value, a predetermined value, or randomly generated value, and a portion of each subsequent wager on a gaming machine associated with the progressive award is allocated to the next progressive award as described above.

A progressive award may be associated with a single gaming machine or multiple gaming machines which each contribute portions of the progressive award. The multiple gaming machines may be in the same bank of machines, in the same casino or gaming establishment (usually through a local area network ("LAN")) or in two or more different casinos or gaming establishments (usually through a wide area network ("WAN")). Such progressive awards are sometimes called local area progressive ("LAP") and wide area progressive ("WAP"), respectively. Progressive awards may increment through communication between a progressive controller and one or more gaming machines. The gaming machines associated with the progressive award transfer coin-in information to a progressive controller. From this information, the progressive controller calculates how much to increment the progressive award based on a set increment rate and then increments the progressive award accordingly. The gaming machines may provide the player a choice between different wager levels prior to the commencement of a primary game. The different wager levels enable the player to win different progressive awards. The gaming devices provide a progressive award (i.e., jackpot) where the value of the jackpot may increase by a particular amount for every game played. Thus, when multiple gaming devices are linked together to form one large progressive jackpot, the jackpot grows more quickly because multiple players are contributing to the jackpot at the same time.

Gaming establishments frequently participate in a wide selection of progressive based award programs. The gaming establishments commonly assign a designated group of gaming devices to a progressive award type. Further, a gaming establishment may be required to account for each gaming device associated with the progressive award, such as by paying a use fee or license fee to a manufacturer or distributor for the progressive system. The use fee or license fee can be paid on a daily basis for each gaming device (which could be a slot machine, video poker machine, video table game, or a mobile gaming device) offering the progressive award which could include a mystery progressive.

In general, a progressive controller is utilized to oversee and control operation of the progressive system. The progressive controller often communicates with the gaming machines and hence manages the progressive for each machine. Also generally, progressive controllers are usually implemented as a stand-alone unit and connected to various gaming devices through a network. That is, in the current state of the art, progressive controllers often comprise a separate physical component having its own processing device, memory, etc., and generally include a key interface for programming the progressive award functionality controlled therein. These stand-alone progressive controllers are then connected via a network to certain gaming machines, where the stand-alone controller controls the progressive award information distributed to each of the connected gaming machines.

With this in mind, various aspects of the functionality disclosed herein implements an integrated progressive controller into the gaming machine (EGM) itself, such that each gaming machine maintains its own progressive controller. A peer-to-peer interconnect is then established to keep the integrated progressive controllers of all gaming machines in the same "bank" or "gaming system" (e.g., a number of gaming machines physically located substantially close together which all contribute/draw from the same progressive award) in sync, such that each gaming machine distributes to one another current progressive award information. In other words, rather than having a single, external stand-alone controller controlling the progressive award information of many gaming machines, the functionality disclosed herein integrates the progressive controller into the logic of each gaming machine, which all interconnect via a peer-to-peer network connection. These mechanisms eliminate the single point-of-failure which would otherwise effectively shut down many gaming machines when using one progressive controller should the one, external progressive controller fail to function correctly. Rather, the functionality of the present disclosure provides technology such that if one gaming machine becomes inoperable, the other gaming machines in the same bank maintain the progressive award information together and may later "catch up" the failed gaming machine by distributing back to it the current progressive award information should the failed gaming machine become operational at a later point. This system also provides many advantages from a regulatory standpoint as each gaming machine and integrated progressive controller combination may require only one approval, rather than separate regulatory commission approvals for separate devices.

Turning now to FIG. 1, FIG. 1 shows an embodiment of a gaming machine (EGM) having both exterior and interior components. The gaming machine may have several components to provide gaming services to users, whom may also be referred to as players. In this particular example, the gaming machine has a cabinet 10, in which are arranged several gaming components. The following discussion gives examples of gaming components and their possible uses. This is not intended to limit either the configuration of a gaming machine to these specific gaming components or to limit the uses of the gaming components to the examples given of their possible uses.

A light or candle 12 may indicate if the game is active, if there is a winner, or to identify a system needing service. A camera 14 may be used to monitor the players, capture video of winners, etc. The camera may be a video camera providing live feed to an image processing gaming component that translated the input images from the camera into images that could be used in the game. For example, an input stream from the camera of a user becoming a winner could be used as input to a bonus game that had images of the user as part of the game.

Similarly, the camera could be a still camera, a combination of both, and either an analog or digital input device. In another example, the video camera could project images of a winner on one of the games to a shared overhead display, enticing others to come play the game. Another example may be the broadcast of a centralized video capture of a game to a centralized display, to several distributed displays and a recording device. This example may provide images of a mechanical or animated roulette table and several betting stations. Speakers 18 may provide music, sound effects or voice instructions to the players, and the system may also have a microphone. A printer 16 provides the capability to printout tickets that generally are used to provide the player with a voucher and may be used to print out other items, such as promotional awards, prize certificates, etc. The voucher can be redeemed for cash. A bill acceptor 20 and a coin acceptor 24 allow the user to insert money to be wagered on the games. The bill acceptor and coin acceptor will also generally validate the coins and bills to ensure that the currency inserted is valid, as well as tracking the amount of currency being inserted. The component referred to here as a bill acceptor may also serve a dual function as a ticket reader. A bill door 22 may provide access to the bill stacker for maintenance functions. A coin hopper 26 dispenses coins when the player cashes out their accumulated winnings. In conjunction with the bill acceptor 20, coin acceptor 24, and printer 16, the gaming machine may include a card reader for accepting or reading a card assigned to a particular player. The card reader or validator may be used to accept or read credit cards, debit cards, or credit slips into which a credit card, debit card, or credit slip is inserted to fund the gaming machine; accept a player identification card reader into which a player identification card is inserted to fund the gaming machine; or any suitable combination thereof.

Other types of gaming components could include 'networked' printers that are controlled by a central system. For example, the printing of a promotional ticket may be done on a printer usually controlled by the game processing unit. When the main system communicates with the printer, it can do so without involving the game processing unit, and the main system may actually take control of the printer away from the game processing unit. This may also be true for commands to print tickets of a certain amount/value, where those commands come from a central accounting system, not the local gaming system or game processing unit. In a configuration such as that shown in FIG. 2, there would not need to be any special wiring or harnessing in the cabinet.

Other gaming components could include keypads, either for security or other uses; biometric devices for identification and security, such as fingerprint scanners, facial recognition modules, voice print identifiers, retinal scanners, etc. The combinations are limited only by the capabilities of the hostless communication link and the ability to include the communications interface in the gaming component.

The access doors 28 provide interior access to the gaming machine components inside the cabinet for service, removal and insertion of new components. Typically located inside the cabinet, in addition to the various controllers for the devices in the gaming machine arranged in the cabinet, is a logic assembly 30 that may include the game processing unit. The game processing unit provides the logic components and the distribution media which contain the games that are played by the player on the system, although it is not necessary that the game processing unit be the provider of the games, as will be discussed in more detail later. The player interacts with the games through the player controls 32 and the display/touch screen 34. The player's progress, as well as the player's account status and other player related information, may be tracked by a player tracking subsystem, 36, which may also be a logic circuit arranged in the cabinet but not always visible to the outside. All of the gaming components discussed so far, as well as many other possibilities, are all arranged in the cabinet and may or may not be visible to the player. Other components of the system may be outside of the cabinet, such as the external storage 42, connected to the components in the cabinet by the communications link 40, and overhead display 38. The overhead display 38 may take data from the camera 14 and display it so that others than the player may see video capture of the player's game, the player when he or she wins, etc.

These gaming components, whether inside or outside the cabinet, will have a controller of some sort and a communications interface allowing the controllers to access a common communications link among the various gaming components. The controllers may vary greatly between the devices. For example, the coin acceptor and bill acceptor may have simple logic circuits and sensors that identify the insertion of coin or currency, validate that the money is valid, and a simple counter that counts how much money has been inserted. These controllers may also have a rejection function that returns invalid money. Similarly, the coin hopper may have a controller that merely receives a signal to release a certain number of different kinds of coins as winnings.

In contrast, the camera controller may be a high-end video processor that reads signals from a charge-coupled device and converts it to digital video or still image data. Similarly, the player controls controller may be a simple voltage generator that generates a voltage for a particular button push, or may be much more complex input apparatus. The display/touch screen may also have a fairly complex controller, to allow rendering of video images, either from the camera or from a file, as well as receiving and interpreting touch screen inputs. The controllers of these devices, regardless of their complexity will govern the functioning of the gaming component as well as communicate through the communications link with other gaming components.

Figure 2:
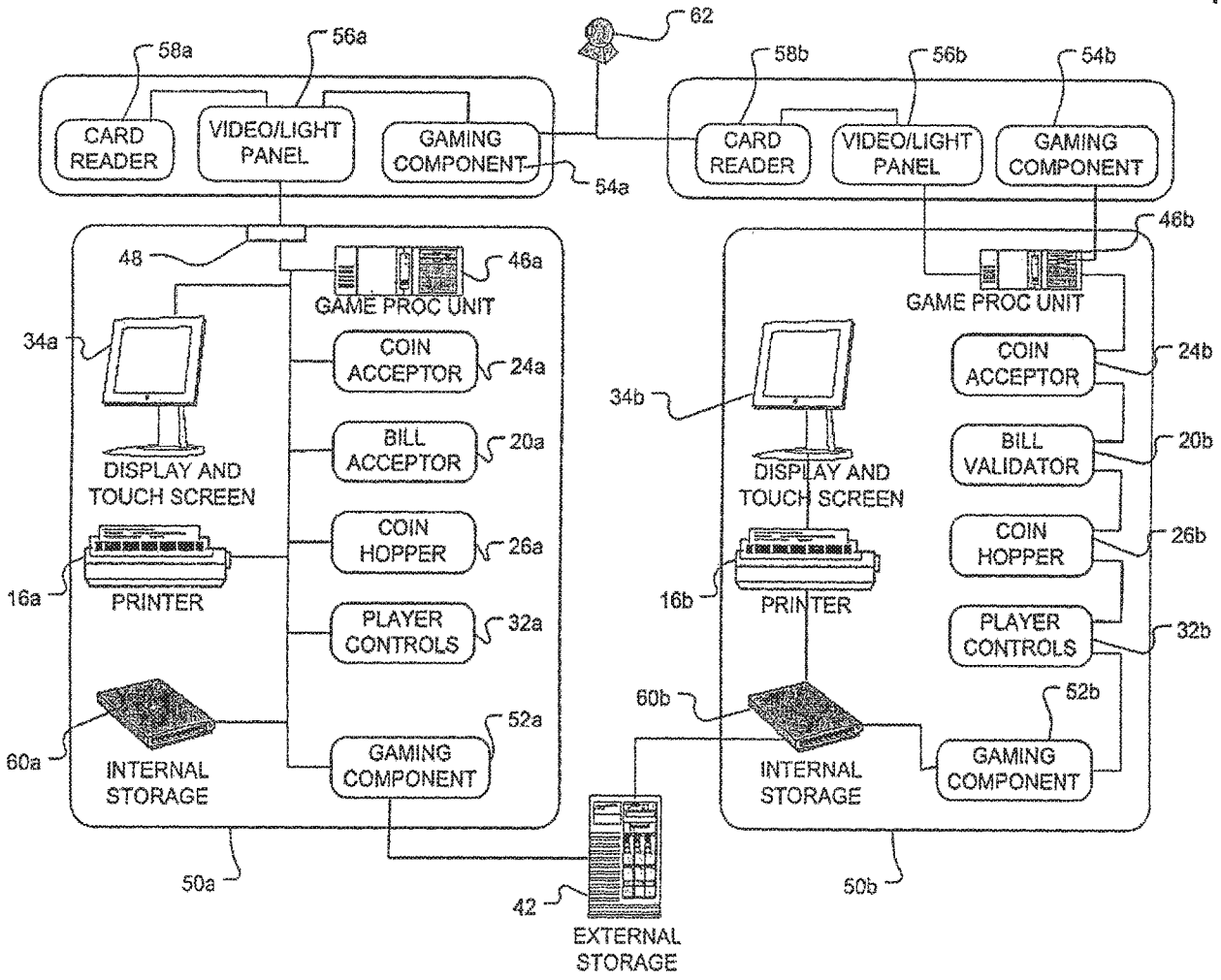
FIG. 2 is a block diagram of a plurality of the gaming devices illustrated in FIG. 1 arranged in a peer-to-peer network configuration.

The gaming system should have some degree of flexibility, allowing gaming components to be switched in and out, added and removed to enhance the gaming experience. The communications link 40 that provides communications between all the components should allow this flexibility. One such communication link is a 'host-less' communications link (e.g., a peer-to-peer connection), where the communications link, such as a bus, does not require one designated device to always function as the master communications controller, through which all the gaming components must communicate. Host-less communications system may have bus control functions, but any device with the appropriate capabilities may take those functions upon themselves, and the functions may be divided among several devices sharing the link. An example of a host-less communication link is the communications protocol set out by the Institute of Electrical and Electronic Engineers (IEEE) standard 1394 (IEEE 1394), which may also be known as FireWire® a trademark of the Apple Computer Corporation or i.LINK® a trademark of Sony Corporation. The IEEE 1394 standard sets out a communications link that is reconfigurable, host-less and very flexible. It also has the capability to provide power through either the backplane or the cables to components, eliminating the need for separate power supplies and adding to the overall flexibility of the configuration. IEEE 1394 compliant communications links reconfigure themselves by the components communicating among themselves to determine who will fulfill what roles and what the relationships are among the various components. This will be discussed with regard to FIG. 2. Further communications protocols that may be used include such protocols as TCP/IP, USB, Bluetooth, IEEE 802.11x (IEEE 802.11 standards), hiperlan/2, HomeRF, etc.) configured to enable the gaming machine to communicate with local and non-local devices using such protocols FIG. 2 shows two gaming machines 50*a* and 50*b* with interior and exterior gaming components, as well as some shared gaming components. All of these gaming components communicate on a peer-to-peer basis, with no dedicated master controller that always manages the communications link between the devices. The elimination of a host allows the gaming system to be reconfigured without concern for communications management. For example, in many current systems, a master controller manages the communications link. Any changes to the master controller, or if the master controller fails, renders the entire gaming system inoperative, as none of the other gaming components can communicate without the master controller.

The host-less communication link may be configured as a backplane bus, where the components have an adapter that allows them to be 'plugged' into a slot on the gaming system backplane, or may be a cable link, where devices all use the same type of cable to communicate through their communications interfaces. In addition, these links may be bridged together. This provides two communications links, one for the gaming components interior to the cabinet, and a communication link between the components in the cabinet and components outside the cabinet. In addition, for the added flexibility of adding components that do not have their own power supplies, the communications link should also provide power, via a backplane or through the cable.

An example of a gaming system having both an interior communications link in the form of a backplane bus and a cable communications link for gaming components outside of the cabinet is shown in gaming system 50*a*. The display and touch screen 34*a*, the printer 16*a*, the internal storage 60*a*, the game processing unit 46*a*, the coin acceptor 24*a*, the bill acceptor 20*a*, the coin hopper 26*a*, the player controls 32*a* and the unspecified gaming component 52*a* all communicate with each other and the bridge 48 via a backplane host-less bus. The unspecified gaming component 52*a* can be any type of gaming component that the system designer desire, with the understanding that the system designer can add additional components as the designer sees fit.

The game processing units 46*a* and 46*b* may each include at least one processor, such as a microprocessor, a microcontroller-based platform, a suitable integrated circuit or one or more ASICs. The processor is in communication with or operable to access or to exchange signals with at least one data storage or memory device. In one embodiment, the processor and the memory device reside within the cabinet of the gaming system. The memory device stores program code and instructions, executable by the processor, to control the gaming system. The memory device also stores other data such as image data, event data, player input data, random or pseudo-random number generators, pay-table data or information and applicable game rules that relate to the play of the gaming system. In one embodiment, the memory device includes random access memory (RAM), which may include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM. Any other suitable magnetic, optical and/or semiconductor memory may operate in conjunction with the player station and gaming system disclosed herein.

In certain embodiments, the at least one memory device is configured to store program code and instructions executable by the at least one processor of the gaming machine to control the gaming machine. The at least one memory device of the gaming machine also stores other operating data, such as image data, event data, input data, random number generators (RNGs) or pseudo-RNGs, paytable data or information, and/or applicable game rules that relate to the play of one or more games on the gaming machine. In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in a gaming machine to implement at least part of the present disclosure. In other embodiments, part or all of the program code and/or the operating data is downloaded to the at least one memory device of the gaming machine through any suitable data network described above (such as an Internet or intranet).

Included in the game processing units 46*a* and 46*b* is the integrated progressive controller. That is, game processing units 46*a* and 46*b* each have comprised within them a separate, integrated progressive controller. In one embodiment, the progressive controller may be implemented as program code stored in the at least one memory device and executed as a software component by the at least one memory device. In another embodiment (not shown), the integrated progressive controller may comprise physical hardware (having its own processor and memory structure) housed within the gaming machine and connected via an interface (e.g., PCI or PCIe, USB, Serial, etc.) to the game processing unit 46*a* and 46*b*.

The progressive controllers integrated into game processing units 46*a* and 46*b* each monitor the gaming machines 50*a* and 50*b* that are connected to the same peer-to-peer network. Again, the peer-to-peer network between gaming machines 50*a* and 50*b* may comprise an interconnect using such communications protocols as USB, Serial, Ethernet, Firewire, I/O debouncer, direct memory map, serial, PCI, parallel, RF, Bluetooth™, near-field communications (e.g., using near-field magnetics), 802.11 (Wi-Fi), etc. The progressive award information of any particular one of the integrated progressive controllers within any particular one of the gaming machines may be transmitted using this peer-to-peer interconnect to each other integrated progressive controller of the gaming machines connected within the same network connection, so as to form a peer-to-peer type "fabric".

The integrated progressive controller also manages the progressive award by performing various accounting procedures (including but not limited to how much of each wager is incremented to the progressive and how much is placed in a reserve account for reseeding a progressive) regarding the amount wagered at each of the game devices 50*a* and 50*b* associated with the peer-to-peer network. The integrated progressive controller assigns a predetermined portion of the amounts wagered at each game device 50*a* and 50*b* to the progressive award amount. The integrated progressive controller also may provide a series of menus displayed on display devices 34*a* and 34*b* for facilitating configuration of the various progressive awards that may be active on the peer-to-peer network.

In some embodiments, in conjunction with the progressive controllers integrated into game processing units 46*a* and 46*b*, a programming key or configuration key is configured to store progressive system parameters and establishes the progressive controller configuration and permits access to the various progressive award configuration menus associated with the progressive controller. This programming key may be comprised of a flash storage or USB "thumb drive". The programming key may be used to access the configuration menus and may be assigned to a particular designated employee of the gaming establishment. In this way, the designated employee is paired with the particular programming key and is responsible for the proper use of the programming key. A "gaming establishment" is defined as an operator of game devices and may comprise a casino, riverboat, cruise ship, lounge, or other business entity providing gaming activities.

In operation, the programming key is inserted into a key interface of the gaming machines 50*a* and 50*b*, and controls access to the progressive controller configuration settings and parameters. Upon insertion of the programming key into the key interface, the gaming machine 50*a* and 50*b* may present a series of progressive controller configuration menus to the user which would not otherwise be visible or accessible. In another embodiment, the programming key may store executable instructions which automatically install and configure the gaming machine 50*a* and 50*b* upon insertion of the programming key. This may eliminate human error in configuration of the progressive award information associated with each machine. Further, upon inserting the programming key into, for example, gaming machine 50*a*, the progressive award configuration settings as specified therein may be automatically propagated to gaming machine 50*b* (and likewise to any other gaming machines interconnected in the peer-to-peer network).

The key parameters, which are stored within the security key (i.e., the programming or configuration key) may comprise, but are not limited to: Gaming Establishment Customer Number, Maximum Number of Game Devices, Maximum Number of Progressives, Progressive Controller Serial Number, Key Serial Number, Key Expiration Parameters or other data considered pertinent to the operation of the gaming machines in the peer-to-peer network.

In some embodiments, a sign controller (not shown) may be connected to the same peer-to-peer network and automatically connect to the network to collect data to be displayed. That is, the sign controller may connect to the overhead display 38 and to the peer-to-peer network and may eavesdrop on the progressive award information being distributed between the integrated progressive controllers of gaming machines 50*a* and 50*b* to display current progressive award information on the overhead display 38 (or any other display associated with the gaming machines 50*a* and 50*b* or on the peer-to-peer network).

The progressive award information may be stored as a 64 bit value in the integrated progressive controller of each gaming machine 50*a* and 50*b*, where the 64 bit value is incremented upon one (or more) of the gaming machines receiving a qualifying wager placed by a player. That is, each integrated progressive controller maintains a digital signature corresponding to the progressive award increase in the form of a 64 bit value. This 64 bit value or digital signature is then incremented and maintained in each integrated progressive controller in each gaming machine 50*a* and 50*b* upon detecting that a qualifying wager (e.g., a wager of a certain value and/or placed under a certain set of rules) has been received from the player. The length of this digital signature ensures that the progressive award information is cryptographically secure and may not be tampered with by outside sources, and further prevents errors in maintaining the progressive award information by each gaming machine.

The progressive award information, as aforementioned, may be maintained by other gaming machines in the peer-to-peer network if one or more gaming machines (e.g., gaming machines 50*a* and/or 50*b*) becomes inoperable. In some embodiments, the progressive award information is "tilted" or reset upon a predetermined number of the gaming machines interconnected in the peer-to-peer network failing, becoming inoperable, or going offline. That is, if, in a gaming system having 10 gaming machines interconnected in the peer-to-peer network and distributing amongst each other the progressive award information, a predetermined number (e.g., 3) gaming machines become inoperable or go offline, the progressive award information is reset across each of the remaining gaming machines in the peer-to-peer network. Otherwise, if the predetermined number is not reached, once the offline gaming machine(s) are detected to have come back online or otherwise become again operational, the current progressive award information (which may have changed since the failed gaming machine(s) went offline) maintained by the integrated progressive controllers of each of the remaining gaming machines is distributed to the gaming machine(s) returning to operational status, and thus the progressive award information is updated in the integrated progressive controllers of the now-operational gaming machine(s).

The progressive accounting may be performed using any operational gaming machine (e.g., gaming machines 50*a* and/or 50*b*) in the peer-to-peer network. That is, any gaming machine in the same bank and connected to the same peer-to-peer network sharing the progressive award information may be used to collect metering information to meet regulatory requirements. This may be implemented as writing metering information to a flash or USB drive inserted into the gaming machine 50*a* or 50*b* in csv format such that the metering information may be easily imported into generic spreadsheet applications.

Components outside the cabinet may communicate via a cabled communications link through the bridge 48, such as the card reader 58*a*, the video light panel 56*a* and any other gaming components such as 54*a*. The exterior or interior gaming components may in turn communicate with other devices that are shared among gaming systems, such as video camera 62. In addition, external devices may communicate by being cabled to an interior device, such as the external storage 42 being linked with the gaming component 52*a*. In contrast, gaming system 50*b* has all of the devices cabled together in one communications link. In either system, the host-less communications link allows high degrees of flexibility in communications that are useful in the gaming environment. For example, in the IEEE 1394 host-less communications link, the bus is reconfigured every time a device is added or removed. This reconfiguration is sometimes referred to as 'reset.'

Upon reset, the communications interfaces of each component determine how many devices are attached to them. Components that have only one other component attached to them are called 'leaf nodes.' Typically, nodes with more than one component attached are called 'branch nodes,' and components that have three or more components are typically designated the 'root node.' In systems where there is more than one possible root node, the protocol defines a method for how to settle which node is the root node. Note that in gaming system 50*a*, the game processing unit 46*a* happens to be the root node. In gaming system 50*b*, the root node is the internal storage 60*a*. Once the tree structure is identified, the root nodes enumerate the components and notify all of the devices of everyone's identification. The devices can now communicate on a peer-to-peer basis, without interaction of any other gaming components.

In gaming system 50*b*, the display and touch screen 34*b* connects to the printer 16*b*, which in turn connects to the internal storage 60*b*. The internal storage 60*b* connects to the external storage 42 and the gaming component 52*b*. The gaming component 52*b* and any intervening gaming components connect with the player controls 32*b*, in turn connecting to the coin hopper 26*b*. This arrangement is repeated between the coin hopper 26*b*, the bill validator 20*b*, the coin acceptor 24*b*, the game processing unit 46*b* and the external devices. Note that the gaming system 50*b* does not require a bridge, as there is only one cabled together system. The communications link will not make any differentiation on the physical level between any of the interior gaming components and the exterior gaming components such as the card reader 58*b*, the video/light panel 56*b* and the gaming component 54*b* as well as any others.

In this manner, the gaming systems can be reconfigured easily and with minimum interruption of the gaming experience for the player. For example, one of the gaming components may be a slot machine interface board (SMIB). The SMIB may communicate across a network with a slot accounting system that provides ticket validation. Once the validation is received at the SMIB, in this example gaming component 52*b*, the print commands could be forwarded to the printer 16*b* without having to involve the gaming processing unit 46*b*.

In another example, a remote game server may be used to "push" game content to the gaming system. In this example, the external storage 42 may be an external application server that provides dynamic, configurable content for players. The server 42 would then be able to communicate directly with the various gaming components needed for the game, such as the display, the player controls and the printer, without involving the CPU.

Figure 3:
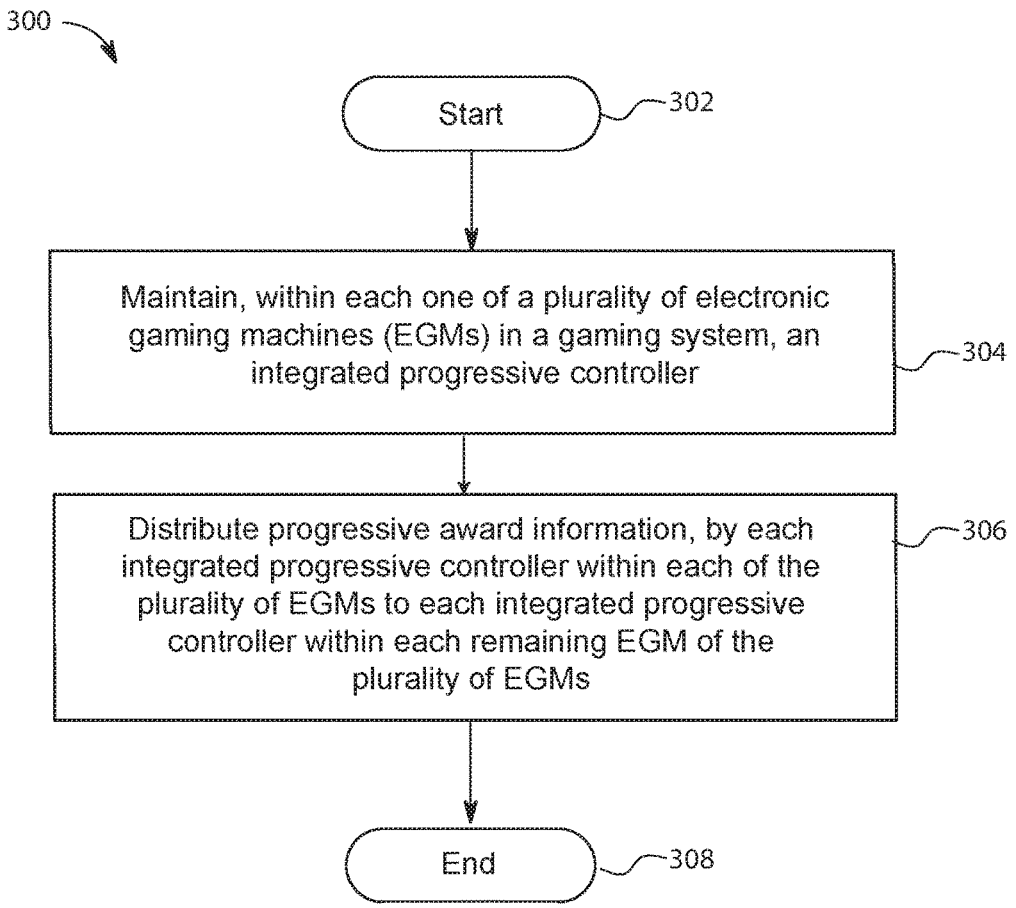
FIG. 3 is a flowchart diagram illustrating a method for providing an integrated progressive controller in each one of the plurality of gaming devices as shown in FIG. 2.
Figure 4:
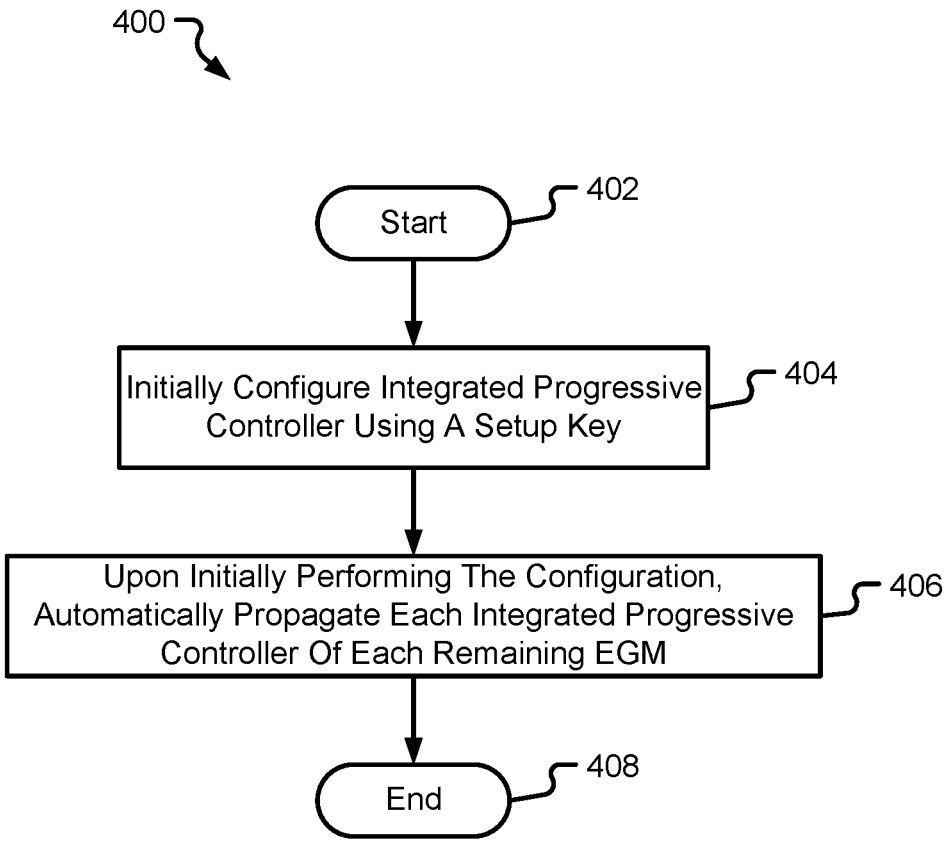
FIG. 4 is a flowchart diagram illustrating a method of configuring an integrated progressive controller in accordance with embodiments of the present disclosure.

Turning now to FIG. 3, FIG. 3 is a flowchart illustrating an exemplary method 300 for providing an integrated progressive controller in each one of the plurality of gaming devices. The method 300 may be implemented in various environments described in FIGS. 1 and 2.

The method 300 starts in block 302, where an integrated progressive controller is maintained within each one of a plurality of electronic gaming machines (EGMs) in the gaming system (step 304). Progressive award information then may be distributed, by each integrated progressive controller within each of the plurality of EGMs to each integrated progressive controller within each remaining EGM of the plurality of EGMs, such that the progressive award information is kept consistent between each integrated progressive controller within each of the plurality of EGMs in the gaming system (step 306). The method 300 ends (step 308).

In combination with the functionality of the method 300, in some embodiments, each integrated progressive controller within each of the plurality of EGMs is in communication with one another via a network.

In some embodiments, the network comprises a peer-to-peer network.

In some embodiments, another method 400 starts 402 and the integrated progressive controller is initially configured within a first one of the plurality of EGMs using a setup key inserted into the first one of the plurality of EGMs, the setup key storing a configuration profile (step 404).

In some embodiments, the setup key comprises a flash drive.

In some embodiments, upon initially performing the configuration of the integrated progressive controller within the first one of the plurality of EGMs, the configuration profile is automatically propagated to each integrated progressive controller of each remaining EGM of the plurality of EGMs (step 406) and then the method 400 ends 408.

In some embodiments, the progressive award information is stored as a 64-bit value within each integrated progressive controller within each of the plurality of EGMs; wherein the 64-bit value is incremented upon identifying a qualifying wager amount is received at one of the plurality of EGMs.

In some embodiments, the progressive award information distributed to each progressive controller within each of the plurality of EGMs is reset or "tilted" upon detecting, by one of the integrated progressive controllers, that a predetermined number of the plurality of EGMs are offline.

As will be appreciated by one skilled in the art, aspects of the present disclosure may be embodied as an apparatus, system, method or a computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "circuit," "module" or "system."

Aspects of the present disclosure have been described above with reference to flowchart illustrations and/or block diagrams of methods, apparatus, and systems according to embodiments of the disclosure. It will be understood that each block of the flowchart illustrations and/or block diagrams, and combinations of blocks in the flowchart illustrations and/or block diagrams, may be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowcharts and/or block diagram block or blocks.

These computer program instructions may also be stored in a computer readable storage medium that may direct a computer, other programmable data processing apparatus, or other devices to function in a particular manner, such that the instructions stored in the computer readable storage medium produce an article of manufacture including instructions which implement the function/act specified in the flowcharts and/or block diagram block or blocks. The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowcharts and/or block diagram block or blocks.

A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that may contain, or store a program for use by or in connection with an instruction execution system, apparatus, or device.

The flowcharts and block diagrams in the above figures illustrate the architecture, functionality, and operation of possible implementations of systems, methods and computer program products according to various embodiments of the present disclosure. In this regard, each block in the flowcharts or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, may be implemented by special purpose hardware-based systems that perform the specified functions or acts, or combinations of special purpose hardware and computer instructions.

What is claimed is:

1. A method of operating a gaming system, by at least one processor, comprising:

providing within each one of a plurality of electronic gaming machines (EGMs) in the gaming system, an integrated progressive controller;

initially configuring the integrated progressive controller within a first one of the plurality of EGMs using a setup key inserted into the first one of the plurality of EGMs, the setup key permitting access to a configuration profile;

distributing progressive award information, by each integrated progressive controller within each of the plurality of EGMs to each integrated progressive controller within each remaining EGM of the plurality of EGMs, such that the progressive award information is kept consistent between each integrated progressive controller within each of the plurality of EGMs in the gaming system; and upon initially performing the configuration of the integrated progressive controller within the first one of the plurality of EGMs, automatically propagating the configuration profile to each integrated progressive controller of each remaining EGM of the plurality of EGMs.

2. The method of claim 1, wherein each integrated progressive controller within each of the plurality of EGMs is in communication with one another via a network.

3. The method of claim 2, wherein the network comprises a peer-to-peer network.

4. The method of claim 3, wherein the first one of the plurality of EGMs comprises a branch node in the peer-to-peer network.

5. The method of claim 1, wherein the setup key comprises a USB key.

6. The method of claim 1, further comprising storing the progressive award information as a 64-bit value within each integrated progressive controller within each of the plurality of EGMs; wherein the 64-bit value is incremented upon identifying a qualifying wager amount is received at one of the plurality of EGMs.

7. The method of claim 1, further comprising resetting a progressive award upon detecting, by one of the integrated progressive controllers, that a predetermined number of the plurality of EGMs are offline.

8. An electronic gaming machine (EGM) for use in a gaming system comprising:

a display;

a communication module;

an integrated progressive controller;

a memory device; and a processor executing instructions stored in the memory device, wherein the instructions, when executed, cause the processor to:

initially configure the integrated progressive controller within the EGM using a setup key inserted into the EGM permitting access to a configuration profile;

distribute progressive award information by the integrated progressive controller to each of a plurality of integrated progressive controllers within each additional EGM of a plurality of EGMs, such that the progressive award information is kept consistent between the integrated progressive controller of the EGM and each integrated progressive controller within each of the additional EGMs of plurality of EGMs in the gaming system; and upon initially performing the configuration of the integrated progressive controller within the EGM, automatically propagate the configuration profile to each integrated progressive controller of each additional EGM of the plurality of EGMs.

9. The EGM of claim 8, wherein the integrated progressive controller within the EGM is in communication with each remaining EGM of the plurality of EGMs via the communication module over a network.

10. The EGM of claim 9, wherein the network comprises a peer-to-peer network.

11. The EGM of claim 8, wherein the setup key comprises a USB key.

12. The EGM of claim 8, wherein when executed by the processor, the instructions cause the processor to:

store the progressive award information as a 64-bit value in the integrated progressive controller within the EGM; wherein the 64-bit value is incremented upon identifying a qualifying wager amount is received at the EGM; and reset a progressive award upon detecting, by one of the integrated progressive controllers, that a predetermined number of the plurality of EGMs are offline.

13. A gaming system comprising:

a network;

a plurality of electronic gaming machines (EGMs) in communication with one another via the network, each of the plurality of EGMs having an integrated progressive controller;

one or more processors within each of the plurality of EGMs; and one or more memory devices within each of the plurality of EGMs that store executable instructions which, when executed by the one or more processors, cause the one or more processors to:

initially configure the integrated progressive controller within a first one of the plurality of EGMs using a setup key inserted into the first one of the plurality of EGMs the setup key permitting access to a configuration profile;

distribute progressive award information, by each integrated progressive controller within each of the plurality of EGMs to each integrated progressive controller within each remaining EGM of the plurality of EGMs, such that the progressive award information is kept consistent between each integrated progressive controller within each of the plurality of EGMs in the gaming system; and upon initially performing the configuration of the integrated progressive controller within the first one of the plurality of EGMs, automatically propagate the configuration profile to each integrated progressive controller of each remaining EGM of the plurality of EGMs.

14. The gaming system of claim 13, wherein each integrated progressive controller within each of the plurality of EGMs is in communication with one another via the network.

15. The gaming system of claim 14, wherein the network comprises a peer-to-peer network.

16. The gaming system of claim 13, wherein the setup key comprises a USB key.

17. The gaming system of claim 13, wherein when executed by the one or more processors, the executable instructions cause the one or more processors to:

store the progressive award information as a 64-bit value within each integrated progressive controller within each of the plurality of EGMs; wherein the 64-bit value is incremented upon identifying a qualifying wager amount is received at one of the plurality of EGMs; and reset a progressive award upon detecting, by one of the integrated progressive controllers, that a predetermined number of the plurality of EGMs are offline.

* * * * *